United States Patent [19]

Crellin et al.

[11] 4,062,368

[45] Dec. 13, 1977

[54] TOBACCO-SMOKE FILTERS

[75] Inventors: Robin Arthur Crellin, Romsey; Christopher Robert Jenkins; James William Percy Phelpstead, both of Southampton, all of England

[73] Assignee: Brown & Williamson Tobacco Corporation, Louisville, Ky.

[21] Appl. No.: 588,258

[22] Filed: June 19, 1975

[30] Foreign Application Priority Data

June 24, 1974 United Kingdom ..... 27958/74

[51] Int. Cl.[2] ..... A24B 15/027

[52] U.S. Cl. ..... 131/265; 131/10.7; 131/207; 131/266; 131/267; 131/269; 55/387; 260/42.14; 260/42.44; 260/42.53

[58] Field of Search ..... 131/265, 269, 266, 267, 131/10.7, 207; 260/42.14, 42.44, 42.53; 55/387

[56] References Cited

U.S. PATENT DOCUMENTS

| | | | |
|---|---|---|---|
| 2,297,248 | 9/1942 | Rudolph | 131/265 |
| 2,876,133 | 3/1959 | Iler et al. | 260/42.14 |
| 3,091,550 | 5/1963 | Doying | 131/269 |
| 3,117,943 | 1/1964 | Corbiere et al. | 260/42.14 |
| 3,217,715 | 11/1965 | Berger et al. | 131/265 |
| 3,256,236 | 6/1966 | Herman et al. | 260/42.14 |
| 3,528,433 | 9/1970 | Johnson et al. | 131/269 |
| 3,544,507 | 12/1970 | Lloyd | 131/265 X |
| 3,652,461 | 3/1972 | Dalton | 260/42.14 |
| 3,856,745 | 12/1974 | Yamaguchi et al. | 260/42.14 |
| 3,894,545 | 7/1975 | Crellin et al. | 131/207 |

*Primary Examiner*—Robert W. Michell
*Assistant Examiner*—T. S. Gron
*Attorney, Agent, or Firm*—William J. Mason

[57] ABSTRACT

According to the invention, a material for the filtration of tobacco smoke by reduction of vapor-phase constituents without adverse effect on the taste of the smoke comprises carbon particles of a size substantially within the range of 300 to 1700 micron, coated over their surfaces, individually and without being bonded together, with a barrier layer which has a thickness within the range of $5 \times 10^{-4}$ to 0.5 micron and which is discontinuous in that it has a porosity within the range of 7,000 to 200,000 $cm^3/min/10\ cm^2$ per 10 cm water gauge and a permeability for organic vapors contained in tobacco smoke such that it permits the passage of molecules within the size range $5 \times 10^{-4}$ to 2 micron, the said layer being composed substantially of an organic non-nitrogen-containing polymeric material which is non-volatile, substantially non-water-soluble and non-toxic. The invention is further concerned with tobacco smoke filters comprising such coated carbon particles.

4 Claims, No Drawings

TOBACCO-SMOKE FILTERS

This invention is concerned with improvements relating to tobacco-smoke filters.

Filters, made from filamentary and/or fibrous sheet material, are known which remove the particulate phase of tobacco smoke by mechanical means. Tobacco smoke contains in addition certain components in the vapour state which cannot be removed by mechanical filtration, but only by absorption and/or adsorption or by chemical reaction.

Activated carbon granules have been found to be a suitable absorbing and/or adsorbing medium. However, carbon has an adverse effect on taste and it is known to add natural or synthetic flavouring agents, or tobacco extract, to mask this characteristic.

It is an object of the present invention to provide a filtering means for tobacco smoke using carbon to reduce some constituents from the vapour phase but without an adverse effect on taste.

To enhance the filtration properties of carbon and make it more selective, it is known to impregnate the carbon with inorganic salts, oxides, non-volatile amino compounds, a chelating agent or a water-soluble ion-exchange material. For bonding carbon particles together in filter-rod manufacture, polymeric thermo-plastics materials, for example polyethylene or polyvinyl pyrrolidone have been used as bonding agents. In these cases, the carbon particles are either saturated with the impregnant to modify the surface properties or bonded together to form a solid mass. It is also known to use uncoated carbon together with a synthetic polymer such as foamed polyhydroxyethylmethacrylate, both in particulate form, as filtering material.

According to the invention, a material for the filtration of tobacco smoke by reduction of vapour-phase constituents without adverse effect on the taste of the smoke comprises carbon particles of a size substantially within the range of 300 to 1700 micron, which particles are coated over their external and internal surfaces, individually and without being bonded together, with a barrier layer which has a thickness within the range of $5 \times 10^{-4}$ to 0.5 micron and which is discontinuous in that it has a porosity within the range of 7,000 – 200,000 $cm^3/min/10\ cm^2$ per 10 cm water gauge and a permeability for organic vapours, including aldehydes, contained in tobacco smoke such that it permits the passage of molecules within the size range $5 \times 10^{-4}$ to 2 micron, the said layer being composed substantially of an organic non-nitrogen-containing polymeric material which is non-volatile, substantially non-water-soluble and non-toxic.

Commercial types of activated carbon may be used as starting material. As stated above, the particle size should be substantially within the range of 300 to 1700 micron. Generally the range will be 500 – 1700 micron, but a small proportion, say about 2%, of very fine particles, i.e. of less than 500 micron size, may be present. Preferably the carbon is in the form of uncompressed granules, but compressed or pelletized granules may be utilized. However, the granules should not be bonded together.

The thickness of the thin barrier layer will depend on the coating material used and the filtration performance required. Although the thickness of the coating on the carbon surface may vary, on average the thickness wil be $5 \times 10^{-4}$ to 0.5 micron. For ordinary practical purposes, it would be inconvenient to determine such small thicknesses as such and the thickness to which the coating is built up can be better expressed by reference to what will be termed the coating level, namely the weight of the coated carbon less the weight of the uncoated carbon divided by the weight of the uncoated carbon and expressed as a percentage. The coating level will generally be within the range of 0.1% to 8%. Simple tests will establish at what limits of coating level a required performance can be reliably obtained. The coating material may be applied to the surface of carbon granules by known immersion or other coating methods in which the material intimately contacts or impinges on the surface of the pores in the granules.

Preferred coating materials are a synthetic polymer of a vinyl compound such as polyhydroxyethylmethacrylate, polymethymethacrylate, polymethacrylic acid, polyvinyl acetate, polyvinyl alcohol. Use may also be made of a synthetic polymer of the condensation type such as a polyester, or a cellulose derivative such as cellulose acetate or carboxymethyl cellulose, or silicones or a natural polymer such, for example, as starch, pectin or alginate. Mixtures of two or more of the above substances may also be used. Naturally the use of substances which are toxic or are themselves a source of an undesired flavour or taste will be avoided.

The coated carbon granules may be used in a filter as a granular bed between two sections or filamentary, fibrous, paper or foam filtering material, such as cellulose acetate tow, paper, or open-cell foamed thermoplastic. The granular bed may be held between two porous or perforated discs or in a porous tube. The coated carbon granules may, alternatively be dispersed in filtering materials of the kind just referred to. The quantity of coated carbon incorporated in a cigarette filter may vary from 10 – 200 mg, preferably 10 – 100 mg.

The following Examples illustrate ways in which the invention can be carried into effect and the filtration-effects thereby achieved. The filtration-efficiency figures given refer to the reduction in total volatile aldehydes in the tobacco smoke. In the Examples, the coating produced had barrier-layer properties within the quantitative ranges stated above.

EXAMPLE 1

Granules carbon grade MF3 (supplied by Chemviron Ltd) with an average particle size of 1100 micron was washed in ethanol and dried prior to the coating process.

Directly before use, three coating solutions of 2-hydroxyethylmethacrylate (MEMA) monomer were prepared in ethanol containing t-butylperoctoate initiator. The percentage ratios of HEMA to ethanol to initiator by volume were 1 : 100 : 0.4, 2 : 100 : 0.4 and 3 : 100 : 0.4 respectively, to be used to give coating levels, as hereinbefore defined, of 0.85, 1.5 and 2.2% respectively.

For coating at each level, approximately 20g of the carbon was placed in a pre-dried, pre-weighed mesh sack and was dried in this constant to weight by maintaining it at 80° C in vacuum overnight. The sack containing the carbon was cooled and immersed in the coating solution for ten minutes and subsequently drained thoroughly by standing in a filter funnel for ten minutes. The monomer coating thus obtained was then polymerised by heating to 80° C for 2 hours in vacuum. Finally the carbon was washed three times in ethanol to remove unreacted monomer and soluble low molecular weight polymer. After redrying at 80° C in vacuum overnight, the coated carbon was weighed to enable the coating level to be established.

For each coating level, 100 mg of the coated carbon was used, unless otherwise stated, as a bed interposed between two cellulose-acetate sections of a triple filter. Such filters were attached to cigarette-tobacco rods, and the cigarettes were smoked through the filters under standard conditions of 1 puff per minute of 35 ml volume and 2 seconds duration. As shown by the table below, good filtration efficiencies for total volatile aldehydes were obtained for all coating levels. Cigarettes with such filters containing the coated carbon and with filters containing a bed of the uncoated carbon particles were evaluated by a panel of smokers. The panel found that the filters with the uncoated carbon produced the undesirable off-taste characteristic of carbon-filter cigarettes, whereas this adverse flavour was absent with the filters containing the coated carbon.

| Coating Level % | Filtration Efficiency % |
|---|---|
| 0.85 | 61 |
| 1.5 | 65 |
| 2.2 | 66 |

EXAMPLE 2

Carbon particles as detailed in Example 1 were similarly coated with the same compound using the following method:

Coating solutions were prepared as in Example 1, but the carbon, dried to a constant weight, was coated by being added to the solution in a beaker and stirred occassionally during coating. After draining the solution through a filter, the carbon was heated to 80° C in vacuum for 2 hours to polymerise the monomer coating. On cooling, the carbon was washed, drained, redried and weighed. Coating levels obtained were 4.8 and 4.0%. Cigarettes were smoked through filters containing the coated carbon as in Example 1. Good filtration efficiency was obtained with the 4.8% coating. A panel of smokers could not detect the taste associated with carbon filters.

| Coating Level % | Filtration Efficiency % |
|---|---|
| 4.8 | 69 |
| 4.8 | 62 |
| 4.0 | 45 |

EXAMPLE 3

Carbon particles as detailed in Example 1 were coated according to the procedure described in Example 1, but using a 1% solution of methacrylic acid in ethanol containing 0.5% -azo-bisisobutyronitrile as the coating solution. The resultant carbon had a 6.5% level of coating of polymethacrylic acid and gave a filtration efficiency of 53% in a triple filter. On smoking cigarettes through this filter, the off taste associated with carbon filters was found to be reduced as compared with filters containing uncoated carbon.

EXAMPLE 4

Carbon particles as detailed in Example 1 were coated according to the procedure described in Example 1, but using a 1% solution of methacrylic acid in ethanol containing 0.5% t-butyl peroctoate as the coating solution. The resultant carbon had a 2.0% level of coating with polymethacrylic acid and gave a filtration efficiency of 54%, with no adverse effect on the taste of the smoke.

EXAMPLE 5

Carbon particles coated as in Example 4 were made up into filters as described in Example 1. These filters, containing 50 and 150 mg of the coated carbon, gave filtration efficiencies of 32% and 69% respectively, with no adverse effect on the taste of the smoke in either case. However, the lower efficiency of 32% is not unexpected with a bed containing only 50 mg of coated carbon.

EXAMPLE 6

Carbon particles as detailed in Example 1 were coated according to the procedure described in Example 2, but using a 5% solution of vinyl acetate in n-hexane containing 0.5% t-butyl peroctoate as the coating solution. The resultant carbon had a 4.5% level of coating with polyvinyl acetate and gave a filtration efficiency of 54%. The off-taste associated with carbon-containing filters was found to be reduced as compared with filters containing uncoated carbon.

EXAMPLE 7

Carbon particles, as detailed in Example 1 were coated according to the procedure described in Example 1, but using a 5% solution of vinyl acetate in acetone containing 0.5% t-butyl peroctoate. The resultant carbon had a 1.5% level of coating with polyvinyl acetate and gave a filtration efficiency of 57%. A reduction in the off-taste associated with filters containing uncoated carbon was observed.

EXAMPLE 8

Carbon particles as detailed in Example 1 were coated according to the procedure described in Example 1, but using a 2% solution of vinyl acetate in n-hexane containing 0.5% t-butyl peroctoate. The resultant carbon had a 16% level of coating with polyvinyl acetate and gave a filtration efficiency of 36%. The coating level was undesirably high and it is doubtful whether this coating represented a barrier having the porosity necessary for the carbon to act as an effective filter for the volatile aldehydes.

EXAMPLE 9

Carbon particles as detailed in Example 1 were coated according to the procedure described in Example 2, but using a 2% coating solution of vinyl acetate in n-hexane containing 0.5% t-butyl peroctoate. The resultant carbon had a 14% level of coating with polyvinyl acetate and gave a filtration efficiency of 43%.

EXAMPLE 10

A cross-linking agent such as ethylene glycol dimethacrylate may be incorporated in the polymer coating. For this purpose, carbon particles as detailed in Example 1 were coated with polyhydroxyethyl-methacrylate using a coating solution containing, in addition to the HEMA monomer and the t-butyl peroctoate initiator, ethylene glycol dimethacrylate in the proportions given below. The coating was produced by the methods of Examples 1 and 2.

| Method | Coating Solution | | | | Coating Level | Filtration Efficiency |
|---|---|---|---|---|---|---|
| | Ethanol | HEMA | Cross Linking agent | t-butyl peroctoate | | |
| As Example 1 | 100 ml | 3 ml | 0.1 ml | 0.5 ml | 1.2 | 52 |
| As Example 2 | 100 ml | 4 ml | 0.1 ml | 0.5 ml | 0.3 | 58 |

The filtration efficiencies were good and no off-taste associated with carbon filters was observed.

EXAMPLE 11

Carbon of the aforesaid MF3 grade and average particle size of 1100 micron was coated with methyl methacrylate monomer, which was subsequently polymerised using an acidic catalyst. A predried, accurately weighed, sample of carbon (10g) was added to 200 mls of water contained in a round-bottomed flask standing in a heating mantle and fitted with a mechanical stirrer, condenser and gas-inlet tube. The methyl methacrylate was added to the flask and the carbon was stirred for ten minutes to allow coating with the monomer to occur. Sulphur dioxide was bubbled for three minutes through the stirred contents of the flask to provide the necessary acidic polymerisation catalyst. The flask was then heated to and maintained at 60° C for 3–5 hours. Finally the carbon was washed with water several times by decantation and was dried in a vacuum oven at 80° C overnight. The coating level was 3.2%. The coated carbon had a filtration efficiency of 49% and the taste associated with carbon filters was noticeably reduced.

In all of the above examples the carbon was initially coated with the monomer concerned. It is, however, possible to coat the carbon with a polymer solution directly, as follows:

EXAMPLE 12

Carbon particles as described in Example 1 were coated for 10 minutes in a beaker containing a solution of cellulose acetate (0.25g) dissolved in a 9:1 mixture of chloroform and ethanol (200 mls). After draining, the carbon was dried under vacuum at room temperature. The resultant coated carbon had a 5% level of coating with cellulose acetate and gave a filtration efficiency of 63%. The off taste associated with carbon filters was materially reduced.

In the performance of the above Examples, it was found that the choice of the initiator or of the coating procedure had little effect on the attainment of a successful coating.

EXAMPLE 13

A triple filter was made comprising a centre section containing a bed of 100 mg of carbon granules (Type BPL supplied by Pittsburgh Activated Carbon Company) of 420 to 1200 micron particle size, which were coated by the procedure in Example 1 with 4.5% by weight of polyhydroxyethylmethacrylate, between two sections of cellulose acetate. On smoking a cigarette through this filter under standard conditions, 46% of volatile aldehydes was removed from the smoke without the adverse taste effect associated with carbon filters. 36% of total particulate material (TPM) was removed. For comparison, a similar filter, but with a bed of uncoated carbon granules as the centre section was used. On smoking a cigarette through this filter, 53% of volatile aldehydes and 32% of TPM were removed, but with an adverse effect on the taste.

We claim:

1. A tobacco-smoke filter which reduces vapor-phase constituents in tobacco smoke without adversely affecting taste, said filter containing from 10 to 200 mg of a particulate material comprised of carbon particles having a size substantially within the range of 300 to 1700 micron, said particles being coated over their external and internal surfaces, individually and without being bonded together, with a discontinuous barrier layer consisting of an organic, nitrogen- free, non-volatile, non-toxic polymer which is substantially water insoluble under conditions of use, said barrier layer having:
   a. a thickness within the range of $5 \times 10^{-4}$ to 0.5 micron,
   b. a porosity within the range of 7,000 to 200,000 $cm^3/min/10\ cm^2$ per 10 cm water gauge, and
   c. a permeability to molecules within the range of $5 \times 10^{-4}$ to 2 microns, said barrier layer being present at a coating level within the range of 0.1% to 8%, said coating level being designated as the weight of the coated carbon less the weight of the uncoated carbon divided by the weight of the uncoated carbon and expressed as a percentage.

2. A tobacco-smoke filter according to claim 1, wherein the polymeric material is a synthetic polymer of a vinyl compound.

3. A tobacco-smoke fitter according to claim 1, wherein the polymeric material is selected from the group consisting of polyhydroxyethylmethacrylate, polymethylmethacrylate and polymethacrylic acid.

4. A tobacco-smoke filter according to claim 1, wherein the polymeric material is polyvinyl acetate.

* * * * *